US011365710B2

(12) United States Patent
Aye et al.

(10) Patent No.: US 11,365,710 B2
(45) Date of Patent: Jun. 21, 2022

(54) HIGH PRESSURE FUEL PUMP

(71) Applicant: Delphi Automotive Systems Luxembourg SA, Bascharage (LU)

(72) Inventors: Andreas Aye, Strassen (LU); Arnaud Leblay, Beuveille (FR)

(73) Assignee: DELPHI AUTOMOTIVE SYSTEMS LUXEMBOURG SA, Bascharage (LU)

( * ) Notice: Subject to any disclaimer, the term of this patent is extended or adjusted under 35 U.S.C. 154(b) by 19 days.

(21) Appl. No.: 16/955,410

(22) PCT Filed: Dec. 12, 2018

(86) PCT No.: PCT/EP2018/084537
§ 371 (c)(1),
(2) Date: Jun. 18, 2020

(87) PCT Pub. No.: WO2019/121224
PCT Pub. Date: Jun. 27, 2019

(65) Prior Publication Data

US 2021/0095626 A1 Apr. 1, 2021

(30) Foreign Application Priority Data

Dec. 21, 2017 (GB) ..... 1721634

(51) Int. Cl.
*F02M 59/02* (2006.01)
*F02M 59/46* (2006.01)
(Continued)

(52) U.S. Cl.
CPC ..... *F02M 63/005* (2013.01); *F02M 59/025* (2013.01); *F02M 59/46* (2013.01);
(Continued)

(58) Field of Classification Search
CPC .. F02M 59/462; F02M 63/005; F02M 59/447; F02M 63/0225; F02M 2200/03;
(Continued)

(56) References Cited

U.S. PATENT DOCUMENTS 8,206,131 B2 * 6/2012 Suzuki ..... F02M 59/462 417/307
8,297,941 B2 * 10/2012 Suzuki ..... F04B 49/243 417/307
(Continued)

FOREIGN PATENT DOCUMENTS

CN 106121889 A 11/2016
DE 102008058288 A1 5/2010
(Continued)

OTHER PUBLICATIONS

JP 2015218678 English Translation (Year: 2015).*

*Primary Examiner* — Dominick L Plakkoottam
(74) *Attorney, Agent, or Firm* — Joshua M. Haines

(57) ABSTRACT

A high pressure fuel pump is provided with a pumping bore and a pressure relief valve only opening to enable a return flow from the outlet conduit back to the compression chamber when the pressure in the outlet conduit exceeds a predetermined threshold. The pressure relief valve is arranged in an elongated pressure relief valve chamber extending parallel and offset to the pumping bore.

6 Claims, 3 Drawing Sheets

(51) Int. Cl.

| | |
|---|---|
| ***F02M 63/00*** | (2006.01) |
| ***F04B 53/16*** | (2006.01) |
| ***F04B 49/03*** | (2006.01) |
| ***F02M 63/02*** | (2006.01) |

(52) U.S. Cl.
CPC ..... *F02M 63/0245* (2013.01); *F04B 49/03* (2013.01); *F04B 53/16* (2013.01)

(58) Field of Classification Search
CPC ..... F02M 2200/8061; F02M 37/0041; F02M 59/025; F02M 59/46; F02M 63/0245; F04B 49/03; F04B 49/243; F04B 11/0033; F04B 39/122; F04B 39/123; F04B 39/125; F04B 53/16
See application file for complete search history.

(56) References Cited

U.S. PATENT DOCUMENTS

| | | | | |
|---|---|---|---|---|
| 9,791,058 | B2 * | 10/2017 | Rickis | F16K 17/04 |
| 10,107,285 | B2 * | 10/2018 | Usui | F04B 39/122 |
| 2006/0222538 | A1 * | 10/2006 | Inoue | F02M 59/462 417/470 |
| 2009/0291006 | A1 * | 11/2009 | Inoue | F02M 59/462 417/441 |

FOREIGN PATENT DOCUMENTS

| | | | | |
|---|---|---|---|---|
| DE | 102009015528 | A1 | | 10/2010 |
| GB | 2267320 | A | | 12/1993 |
| JP | 2015218678 | A | * | 12/2015 |
| JP | 2015218678 | A | | 12/2015 |

* cited by examiner

HIGH PRESSURE FUEL PUMP

CROSS REFERENCE TO RELATED APPLICATIONS

This application is a national stage application under 35 USC 371 of PCT Application No. PCT/EP2018/084537 having an international filing date of Dec. 12, 2018, which is designated in the United States and which claimed the benefit of GB Patent Application No. 1721634.2 filed on Dec. 21, 2017, the entire disclosures of each are hereby incorporated by reference in their entirety.

TECHNICAL FIELD

The present invention relates to a gasoline high pressure pump and more, particularly to a pressure relief valve therein arranged.

BACKGROUND OF THE INVENTION

A gasoline fuel injection system of an internal combustion engine has a pump wherein gasoline is pressurised by a piston reciprocating in a pumping bore for varying the volume of a compression chamber. To prevent over-pressure downstream the pump, for instance during hot-soak or testing without injections, said pump is provided with a pressure relief valve (hereafter PRV) enabling fuel to flow back to the compression chamber.

The PRV comprises a spring biasing a ball on a conical seat at the center of which opens a spill orifice. The PRV is normally closed and only opens when the opening force generated by the pressure on the ball overcomes the spring closing force, said opening force being a function of the predetermined opening threshold pressure and of the spill orifice diameter.

Overtime, the raising efficiency of the engine drives to increase the operating pressure and to diminish the pump dimensions, said opposed requirements having driven to arrange the PRV transverse to the pumping bore, and by having an important pressure and a small PRV opening force, this requiring a small spill orifice and a lengthy spring of small diameter. As said engine efficiency increases, such compromise is no longer acceptable.

SUMMARY OF THE INVENTION

Accordingly, it is an object of the present invention to resolve the above mentioned problems in providing a high pressure fuel pump for a gasoline direct injection fuel equipment of an internal combustion engine, said pump having a body provided with a pumping bore extending along a pumping axis and defining, at an end, a compression chamber which volume is cyclically varied by a piston reciprocating in said pumping bore. An inlet conduit controlled by an inlet valve and an outlet conduit controlled by an outlet valve open in said compression chamber. The outlet valve is normally closed and only opens when the pressure in the compression chamber exceeds a first predetermined threshold enabling pressurised fuel to be expelled into the outlet conduit. The pump further comprises a pressure relief valve (PRV) normally closed and only opening to enable a return flow from the outlet conduit back to the compression chamber when the pressure in the outlet conduit exceeds a second predetermined threshold superior to the first threshold. Said PRV comprises a resilient valve member and a seat and is arranged in an elongated PRV chamber extending parallel and offset to the pumping bore, said PRV chamber being sealed at an end by a plug member.

The pump body outer dimension transverse to the pumping axis may be defined at least by the addition of the pumping bore diameter, the PRV chamber diameter and the thickness of a wall separating said bore and said chamber.

Said seat may be defined in said plug member.

Said plug member may be provided with an internal fluid communication, extending between the centre of the seat and the bottom of hollow dug on an outer face of said plug member.

Said plug member may be a cylinder having a cylindrical peripheral face extending between a transverse circular inner end face, defining the seat and, an opposed transverse circular outer end face and wherein, said hollow is defined by an annular groove dug in said peripheral face.

The fluid communication may comprise a transverse drilling opening in said groove and an axial drilling extending between the said transverse circular inner end face and said transverse drilling.

Each of the end portions of the peripheral face of the plug member extending on each side of the groove may be press-fitted in the PRV chamber with interference with the wall of said chamber.

BRIEF DESCRIPTION OF THE DRAWINGS

The present invention is now described by way of example with reference to the accompanying drawings in which.

DESCRIPTION OF THE PREFERRED EMBODIMENTS

Figure 1:
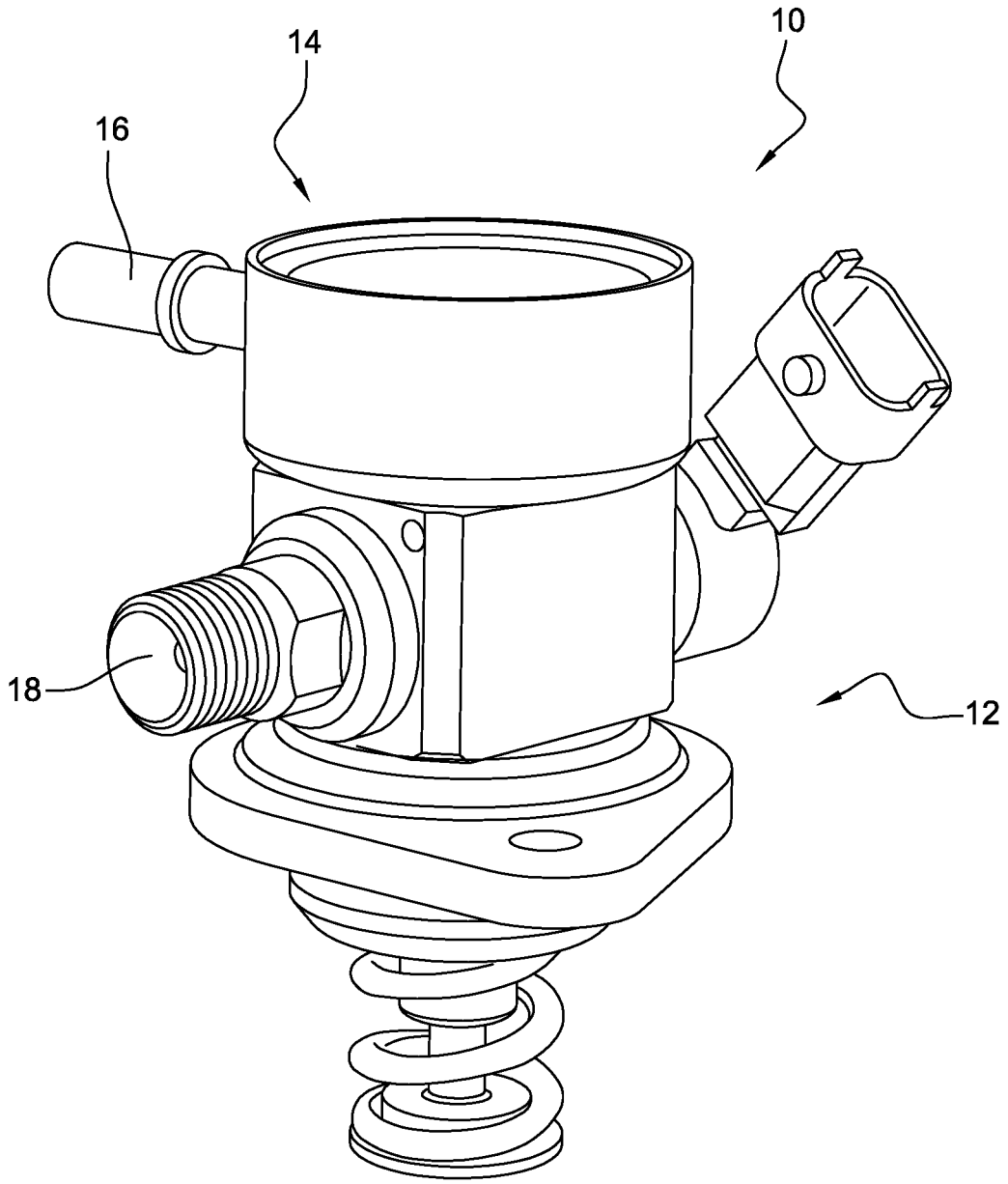
FIG. 1 is a 3D view of a gasoline fuel pump.
Figure 2:
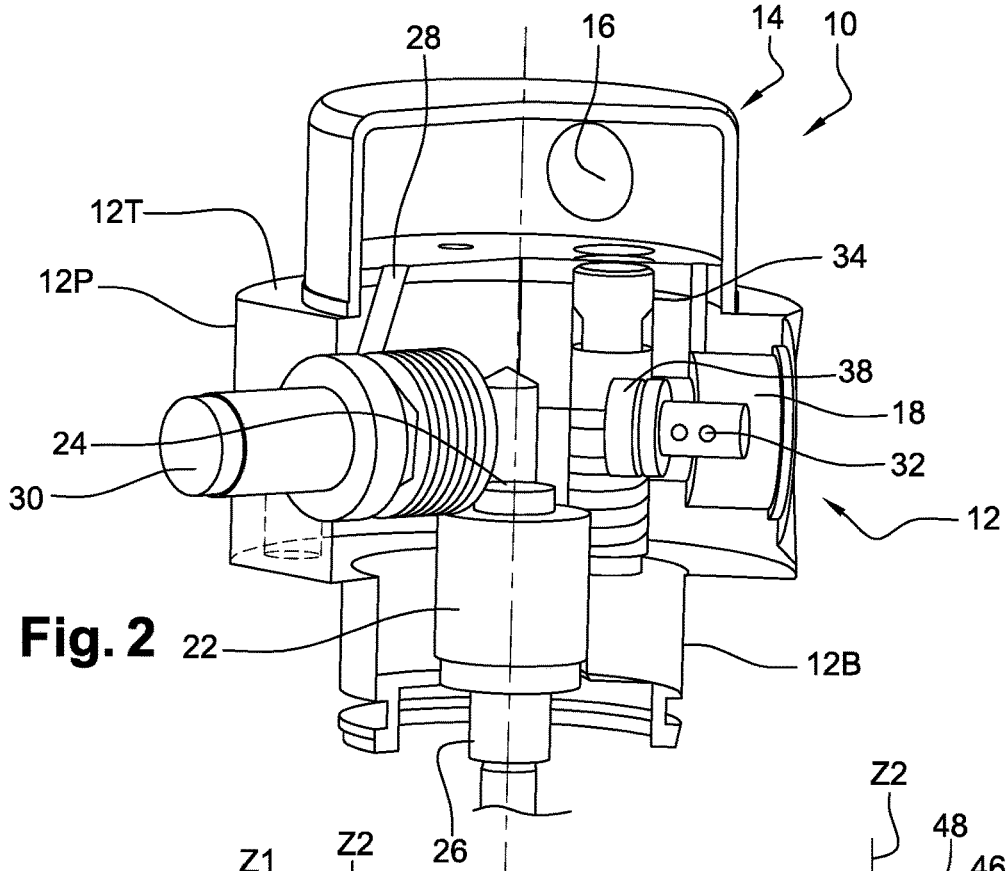
FIG. 2 is a 3D section enabling to visualize the inside of said pump.
Figure 3:
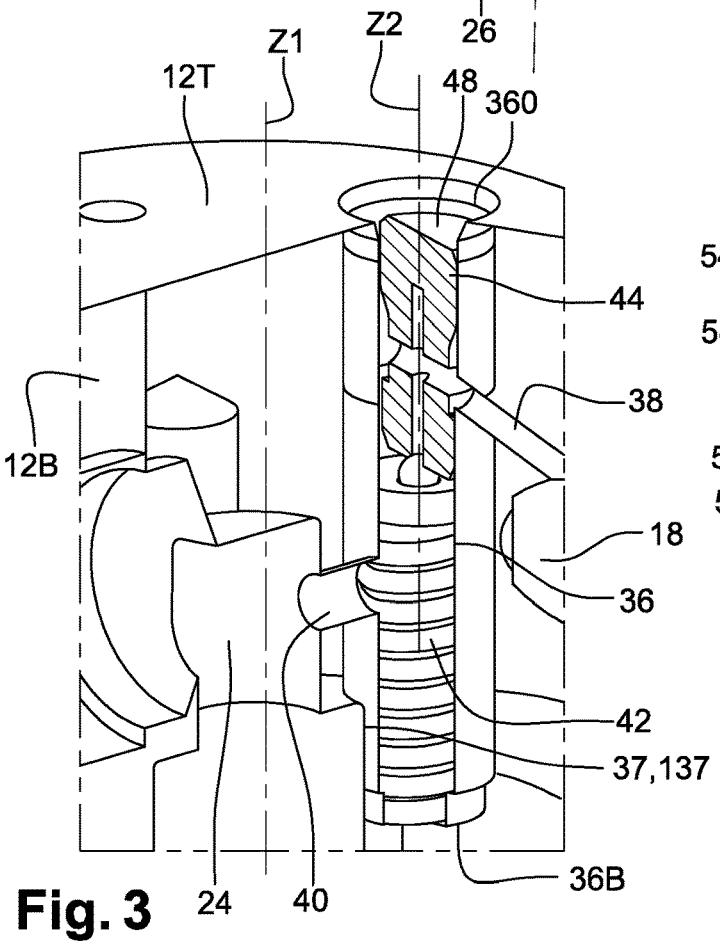
FIGS. 3 and 4 are details of FIG. 2.
Figure 4:
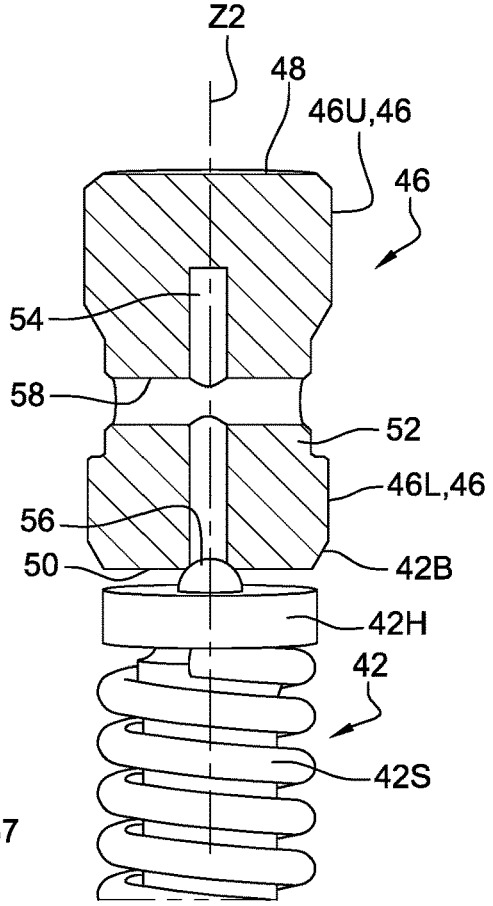
Figure 5:
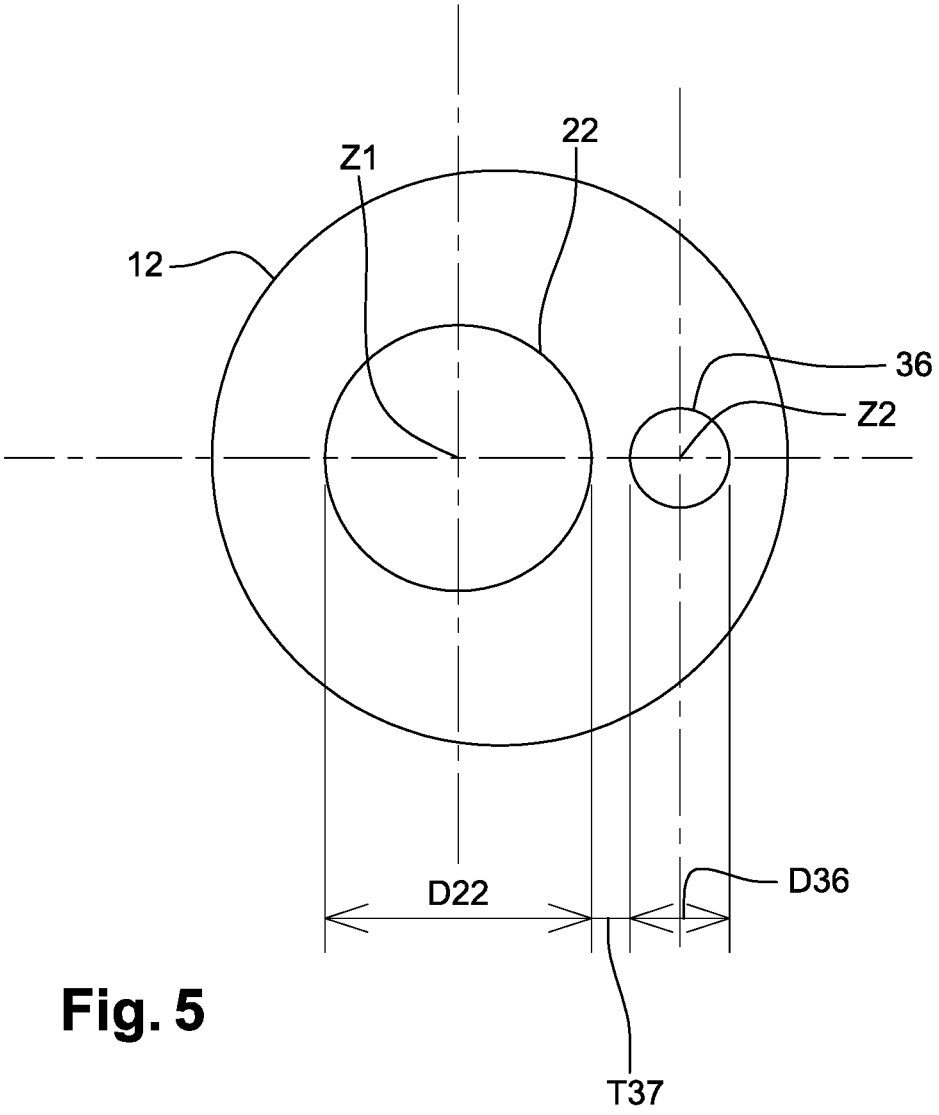
FIG. 5 is a sketch of a top section of said pump.

A gasoline direct injection equipment of an internal combustion engine comprises a pump 10 that pressurizes gasoline prior to deliver it to a high pressure reservoir, well known as a common rail that stores and distributes said fuel to injectors.

The pump 10 comprises a pressurising unit 12 on which is arranged a damper 14. A low pressure inlet 16 is arranged in the damper and, a high pressure outlet 18 is arranged in the pressurising unit 12.

The damper 14 is housed in a cylindrical can provided with a hole for arranging the inlet 16. Inside said housing is arranged a flat deformable capsule (or several, not shown) that deforms and damp fluid waves propagating in the low pressure circuit.

The pressurising unit 12 has a body 12B having a top face 12T, on which is fixed said damper 14, and peripheral faces 12P. Said body 12B is provided with a pumping bore 22 extending along a pumping axis Z1 and extending between a blind end defining a compression chamber 24 and an opening in the bottom side of the pressurising unit 12.

In said bore 22, a piston 26 is guided to reciprocal displacements varying the volume of said compression chamber 24 and, in said compression chamber 24 open an inlet conduit 28 controlled by an inlet valve 30 and said outlet conduit 18 controlled by an outlet check valve 32, said outlet 18 extending from a peripheral face 12P of the pressurising unit 12.

Said check valve 32 comprises a seat member closing a cup-like housing, inside of which a spring biases a ball, or another valve member, to close a central drilling arranged in said seat member. The seat member is arranged close to the compression chamber 24 and, the housing extends in the outlet conduit 18, thus creating an outlet controlled fluid communication between the chamber 24 and the outlet conduit 18.

When the piston 26 moves toward the Top Dead Centre position (TDC) the pressure in the compression chamber 24 rises and, when it reaches a first threshold P1 it pushes the ball away from the seat, opening said outlet fluid communication, enabling fuel to be expulsed from the compression chamber flowing through the drilling of the seat, around the ball then through the holes of the housing to finally reach the outlet conduit 18.

The pump 10 further comprises a pressure relief valve 34 (hereafter PRV) that is another check valve controlling, in the opposite direction as the outlet check valve 32, another fluid communication between the compression chamber 24 and the outlet conduit 18. The PRV 34 is normally closed and it only opens to enable a return flow from the outlet conduit 18 back to the compression chamber 24 when the pressure in the outlet conduit 18 exceeds a second threshold P2 superior to the first threshold P1.

In normal use, the PRV 34 remains closed and the fuel in the outlet conduit 18 is pressurised to a level between the first P1 and the second P2 threshold but, for instance during hot-soak, should engine heat slowly diffuses and heats up pressurised fuel remaining in the outlet conduit 18, the pressure of said fuel rises and to prevent damages the PRV 34 opens when said pressure reaches the second threshold P2 enabling fuel to return from the outlet conduit 18 to the compression chamber 24 and, then to lower the pressure in the outlet conduit 18.

More in details, said PRV 34 is housed in a cylindrical PRV chamber 36 extending along a PRV axis Z2 parallel and offset to the pumping axis Z1, and said PRV chamber 36 is drilled in the body 12B of the pressurising unit parallel to the pumping bore 22, the PRV chamber 36 and the pumping bore 22 being separated by a wall 37 of thickness T37.

The PRV chamber 36 extends between an opening 360 in a top face 12T of said pressurising unit to a blind bottom end 36B. A PRV inlet channel 38 extends between the outlet conduit 18 and said PRV chamber where it opens close to the chamber opening 360. Lower in the PRV chamber opens a PRV outlet channel 40 extending to the compression chamber 24.

Inside the PRV chamber 36 a resilient valve member 42 and a plug member 44 are arranged. In the non-limiting example of the description, said valve member 42 comprises a ball 42B placed in a holder member 42H forming a cylindrical extension around which are coiled the end turns of a spring 42S. The plug member 44 is cylindrical and it is press-fitted with interference in the PRV chamber sealingly closing said opening 36. Other known means for fixing the plug member in the PRV chamber may be chosen such as welding, tightening . . . . Said cylindrical plug member 44 defines an outer face 46 extending between an outer end face 48, oriented toward said top face 12T, and an opposed inner end face 50 oriented inside the PRV chamber. The outer face 46 is provided with a large annular groove 52 surrounding the plug member and separating said outer face 46, in an upper portion 46U joining the top end face, a lower portion 46L joining the inner end face and, said middle groove 52. The plug member 44 is further provided with an axial Z2 drilling 54 extending between the center of the inner end face 50, where it opens defining a seat 56, and a blind end inside the plug member and, a transverse drilling 58 extending across the plug member between opposed openings in the bottom of the groove 52, said transverse drilling 58 intersecting the axial drilling 54.

Once arranged in the PRV chamber 36, the plug member 44 sealingly closes the opening 360 of the chamber by having both upper 46U and lower 46L portions of the outer face press fitted with interference against the wall of the PRV chamber. The groove 52 defines an annular void surrounding the plug member and, the PRV inlet channel 38 opens in said annular void.

As shown on the figures, the resilient valve member 42 is arranged in the PRV chamber, the ball 42B being urged against the seat 56 by the spring 42S that is compressed between the bottom end 36B of the PRV chamber and said plug member 44.

A controlled return fluid communication is then defined between the outlet conduit 18 and the compression chamber 24, said communication comprising the PRV inlet channel 38, the void of the groove 52, the axial 54 and transverse 58 drillings, the PRV chamber 36 and the PRV outlet channel 40.

Other arrangements may be chosen for instance a non-surrounding local hollow dug in the plug member outer face may replace the groove, the PRV inlet opening in said hollow. This may necessitate to angular orientation of the plug member in the PRV chamber but it would still define said return fluid communication. The axial 54 and transverse 58 drillings may be replaced by other drillings, eventually by only one drilling angularly drilled in the plug member.

The second pressure threshold P2 necessary to open the PRV 34 is calculated as a function of the seat 56 diameter and the stiffness of the spring 42S. Indeed, a small seat diameter limits the surface of the ball on which the pressure is applied which in turn limits the required spring stiffness.

Thanks to this arrangement of the PRV 34 parallel to the pumping bore 22 the packaging of the pump 10 is reduced over the known pumps. Indeed the external dimension of the body 12B of the pressurising unit is reduced as being driven by the diameter D22 of the pumping bore, the diameter D34 of the PRV chamber and the thickness T37 of the wall 37 separating the pumping bore from the PRV chamber.

LIST OF REFERENCES

Z1 pumping axis
Z2 PRV axis
P1 first pressure threshold
P2 second pressure threshold
D22 diameter of the pumping bore
D36 diameter of the PRV chamber
T37 thickness of the separating wall
10 pump
12 pressurising unit
12B body of the pressurising unit
12T top face of the pressurising unit
12P peripheral face of the pressurising unit
14 damper
16 LP inlet
18 HP outlet—outlet conduit
20 damper housing
22 pumping bore
24 compression chamber
26 piston
28 inlet conduit
30 inlet valve

32 outlet check valve
34 pressure relief valve—PRV
36 PRV chamber
360 opening of the PRV chamber
36B bottom of the PRV chamber
37 wall
38 PRV inlet channel
40 PRV outlet channel
42 valve member
42B ball
42H holder
42S spring
44 plug member
46 outer face
46U upper portion of the outer face
46L lower portion of the outer face
48 outer end face
50 inner end face
52 groove
54 axial drilling
56 seat
58 transverse drilling

The invention claimed is:

1. A high pressure fuel pump for a gasoline direct injection fuel equipment of an internal combustion engine, said high pressure fuel pump comprising:

a body provided with a pumping bore extending along a pumping axis and defining, at an end, a compression chamber which volume is cyclically varied by a piston reciprocating in said pumping bore;

an inlet conduit controlled by an inlet valve;

an outlet conduit controlled by an outlet valve, said outlet valve being normally closed and only opening when the pressure in the compression chamber exceeds a first predetermined threshold, thereby enabling pressurised fuel to be expelled into the outlet conduit; and a pressure relief valve (PRV) normally closed and only opening to enable a return flow from the outlet conduit back to the compression chamber when the pressure in the outlet conduit exceeds a second predetermined threshold superior to the first predetermined threshold, said PRV comprising a resilient valve member and a seat and being arranged in an elongated PRV chamber extending parallel and offset to the pumping bore, said elongated PRV chamber being sealed at an end by a plug member;

wherein said elongated PRV chamber extends to a blind bottom end; and wherein said seat is defined in said plug member such that said seat is formed on an inner end face of said plug member which faces toward said blind bottom end and such that said PRV is located between said seat and said blind bottom end.

2. A pump as claimed in claim 1 wherein, said plug member is provided with an internal fluid communication extending between a centre of the seat and a bottom of a hollow dug on an outer face of said plug member.

3. A pump as claimed in claim 2 wherein said plug member is a cylinder having a cylindrical peripheral face extending between said inner end face; and an opposed transverse circular outer end face and wherein, said hollow is defined by an annular groove dug in said cylindrical peripheral face.

4. A pump as claimed in claim 3, wherein the fluid communication comprises a transverse drilling opening in said annular groove and an axial drilling extending between the said inner end face and said transverse drilling.

5. A pump as claimed in claim 4, wherein end portions of the peripheral face of the plug member extending on each side of the groove are each press-fitted in the elongated PRV chamber with interference with a wall of said chamber.

6. A pump as claimed in claim 3, wherein end portions of the peripheral face of the plug member extending on each side of the groove are each press-fitted in the elongated PRV chamber with interference with a wall of said chamber.

* * * * *